US009232867B2

(12) United States Patent
Chang

(10) Patent No.: US 9,232,867 B2
(45) Date of Patent: Jan. 12, 2016

(54) PAD STRUCTURE

(71) Applicant: Min-Chia Chang, Tainan (TW)

(72) Inventor: Min-Chia Chang, Tainan (TW)

( * ) Notice: Subject to any disclaimer, the term of this patent is extended or adjusted under 35 U.S.C. 154(b) by 0 days.

(21) Appl. No.: 14/188,822

(22) Filed: Feb. 25, 2014

(65) Prior Publication Data

US 2015/0020315 A1 Jan. 22, 2015

(30) Foreign Application Priority Data

Jul. 19, 2013 (TW) ..... 102213736 U

(51) Int. Cl.
*B68G 5/00* (2006.01)
*A47C 16/00* (2006.01)
*A47G 9/10* (2006.01)

(52) U.S. Cl.
CPC . *A47G 9/10* (2013.01); *A47G 9/109* (2013.01); *A47G 2009/1018* (2013.01)

(58) Field of Classification Search
CPC ..... A47G 9/10; A47G 9/1009; A47G 2009/1018; A47G 9/1027; A47G 9/1081; A47G 9/109; A61G 5/1043; A61G 2005/1045; A61G 7/1084; A61G 13/121
See application file for complete search history.

(56) References Cited

U.S. PATENT DOCUMENTS 1,447,288 A * 3/1923 Emmerich ..... 5/645
4,021,871 A * 5/1977 Wortman ..... 5/636
4,508,044 A * 4/1985 Downey et al. ..... 112/475.08
4,899,405 A * 2/1990 Rothbard ..... 5/636
5,016,303 A * 5/1991 Tanaka et al. ..... 5/636
5,163,194 A * 11/1992 Dixon ..... 5/636
5,168,590 A * 12/1992 O'Sullivan ..... 5/490
5,367,731 A * 11/1994 O'Sullivan ..... 5/645
5,644,810 A * 7/1997 Kato ..... 5/645
5,765,245 A * 6/1998 Breto ..... 5/640
5,809,594 A * 9/1998 Isogai ..... 5/645
5,864,904 A * 2/1999 Rudick ..... 5/640
6,182,312 B1 * 2/2001 Walpin ..... 5/636
6,671,906 B1 * 1/2004 Milligan ..... 5/636
7,089,617 B1 * 8/2006 Lauro ..... 5/636
D551,704 S * 9/2007 Nakamura ..... D19/26
7,578,014 B1 * 8/2009 Rodriguez ..... 5/636
8,245,339 B2 * 8/2012 Murray et al. ..... 5/657
D677,963 S * 3/2013 Jones ..... D6/597
D723,304 S * 3/2015 Chang ..... D6/601
2005/0150051 A1 * 7/2005 Greenawalt et al. ..... 5/636
2009/0205135 A1 * 8/2009 Asaka et al. ..... 5/639
2011/0131729 A1 * 6/2011 Shiao ..... 5/640
2011/0290834 A1 * 12/2011 Pelz et al. ..... 224/259
2012/0272453 A1 * 11/2012 Jaskot ..... 5/644
2013/0076003 A1 * 3/2013 Lanci et al. ..... 280/304.1
2014/0053336 A1 * 2/2014 Cai ..... 5/636
2014/0082846 A1 * 3/2014 Blazar ..... 5/645
2014/0115790 A1 * 5/2014 Romano et al. ..... 5/652.2
2014/0196214 A1 * 7/2014 DuPre ..... 5/644

* cited by examiner

*Primary Examiner* — David E Sosnowski
(74) *Attorney, Agent, or Firm* — Rosenberg, Klein & Lee

(57) ABSTRACT

A pad structure contains a pad unit having a lateral gap formed along a peripheral side thereof. The pad unit has a first pad body and a second pad body which are at least partially spaced apart from each other by the lateral gap. The pad unit is used as a pillow and has two pad bodies for increasing support capability. In addition, the lateral gap between the two pad bodies can absorb a part of deformation. In other words, the two pad bodies flexibly expend and retract in the lateral gap so as to prevent the pad unit from depression and deformation and to well support a user's head.

9 Claims, 12 Drawing Sheets

PAD STRUCTURE

FIELD OF THE INVENTION

The present invention relates to a pad structure, and more particularly to a pad unit which includes a lateral gap defined around a peripheral side of the pad unit so as to separate two pad bodies which are located on an upper layer and a lower layer of the pad unit, thus enhancing flexibility and support capability of the pad unit and preventing the pad unit from depression and deformation.

BACKGROUND OF THE INVENTION

A conventional pad is provided to make user lay or sit thereon, so if it does not have enough support capacity, the user cannot lay or sit comfortably. For instance, the user feels painfully or uncomfortably after lying on the pad for a long period of time, or a deformation will occur when the pad does not have sufficient support capacity or flexibility, thus influencing sleeping.

TW Utility Model No. M437137 disclosed a conventional pad structure containing a pillow body and a plurality of sewing threads formed on the pillow body. The pillow body has a first connecting section, a second connecting section opposite to the first connecting section, and plural closed cavities defined among the plurality of sewing threads, wherein the first connecting section is coupled with the second connecting section so that a gap forms after the pillow body is folded. Furthermore, a plurality of fillers are filled in the plural closed cavities so as to obtain flexibility and support capacity after folding the pillow body. The plural closed cavities are arranged to prevent the plurality of fillers moving randomly in the pillow body, thus avoiding deformation of the pillow body.

However, such a conventional pillow body cannot support user's head securely and comfortably when the user sleeps at improper postures, thus causing pain and stiff to user's neck.

The present invention has arisen to mitigate and/or obviate the afore-described disadvantages.

SUMMARY OF THE INVENTION

The primary objective of the present invention is to provide a pad structure which is capable of overcoming the shortcomings of the conventional pad structure.

To obtain the above objective, a pad structure provided by the present invention contains a pad unit having a lateral gap formed along a peripheral side of the pad unit, the pad unit including a first pad body and a second pad body which are at least partially spaced apart from each other by the lateral gap.

Preferably, the first and second pad bodies each are formed by folding a pad sheet. Each pad sheet includes an inner surface and an outer surface opposite to the inner surface and is a quadrilateral bounded by a first side, a second side, a third side, and a forth side, wherein the first side is opposite to the third side. Each pad sheet is folded from the first and third sides thereof toward the inner surface thereof and the first and third sides thereof are adhered to each other to form a respective one of the first and second pad bodies.

Preferably, with the first and third sides thereof being folded and adhered to each other, each pad sheet has the second side and the fourth side being respectively adhered in a thickness direction.

Preferably, the pad sheets are made of any one of sponge, foam, latex and memory foam.

Preferably, at least one of the pad sheets has a cool gel layer covered on the outer surface thereof.

Preferably, each pad sheet has a plurality of granular portions arranged on the inner surface thereof.

Preferably, one of the pad sheets has four inner pads being disposed on the inner surface thereof and being respectively close to the first side, the second side, the third side, and the fourth side thereof; the other one of the pad sheets has three inner pads being disposed on the inner surface thereof and being respectively close to the second side, the third side, and the fourth side thereof.

Preferably, the pad structure further contains a protective cover. The protective cover has an accommodating space defined therein and has a zipper for closing the accommodating space, and the accommodating space fits with the pad unit so as to receive the pad unit therein.

Preferably, each pad sheet comprises a case member. Each case member has: two sewing threads disposed thereon; an inner space divided into three filling spaces by the two sewing threads; and three fillers respectively filled in the three filling spaces. Each case member has two opposite sides being bent inwardly along the two sewing threads dispose thereon and being adhered to each other.

Preferably, the fillers are any one of cotton, silk and feathers.

Thereby, the pad structure of the present invention has the following advantages:

1. The pad unit includes two pad bodies located on an upper layer and a lower layer of the pad unit and overlapped together, thus enhancing support capability to facilitate good sleep.

2. The lateral gap is defined between the two pad bodies so as to absorb a part of the deformation. In other words, the two pad bodies flexibly expend and retract in the lateral gap so as to prevent the two pad bodies from depression. Furthermore, the plurality of granular portions on each inner surface are configured to support the user's head, thereby preventing the two pad bodies from deformation.

3. The central portion of each of the two pad bodies are surrounded by inner pads so that when the two pad bodies support the user's head, the central portion of each pad body becomes concaved to match with a profile of the user's head and to avoid forcing user's occipital bone.

4. The user's head can be propped up at a height corresponding to the width of the user's shoulder by the inner pads, such that user's neck does not bear additional compressive stress even when the user lies on his/her side, thus avoiding neck's pain and stiff.

5. The user can let his/her head be propped up at a higher position or at a lower portion because the pad unit has a first portion supported by two overlapped inner pads and a second portion supported by single inner pad.

6. One of the two outer surfaces has a cool gel layer covered thereon so as to provide cool comfort in summer.

DETAILED DESCRIPTION OF THE PREFERRED EMBODIMENTS

Figure 1:
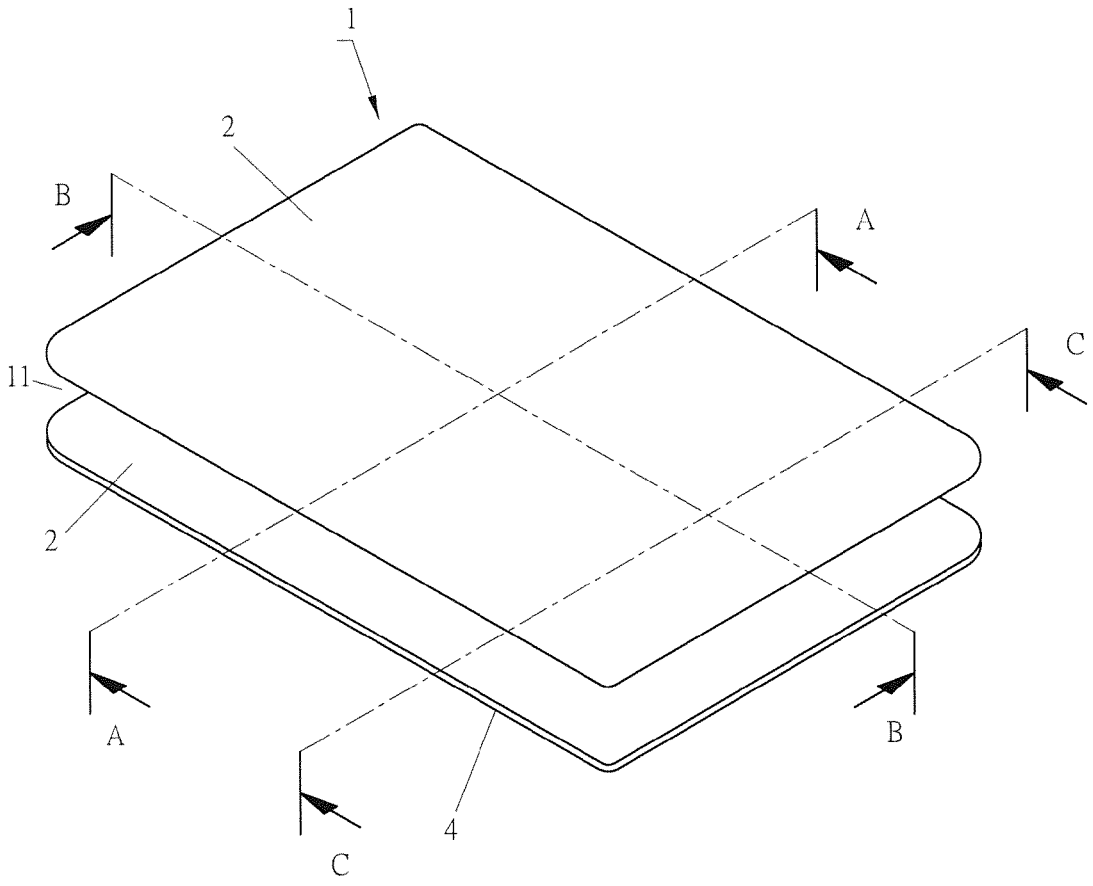
FIG. 1 is a perspective view showing the assembly of a pad unit of a pad structure according to a first embodiment of the present invention.

With reference to FIG. 1, a pad structure according to a first embodiment of the present invention comprises a pad unit 1. The pad unit has a lateral gap 11, a first pad body 2, and a second pad body 2. The lateral gap 11 formed along an outer peripheral side of the pad unit 1 so that the first pad body 2 and the second pad body 2 are at least partially spaced apart from each other by the lateral gap 11. The first pad body 2 is an upper portion of the pad unit 1, and the second pad body 2 is a lower portion of the pad unit 1.

Figure 2:
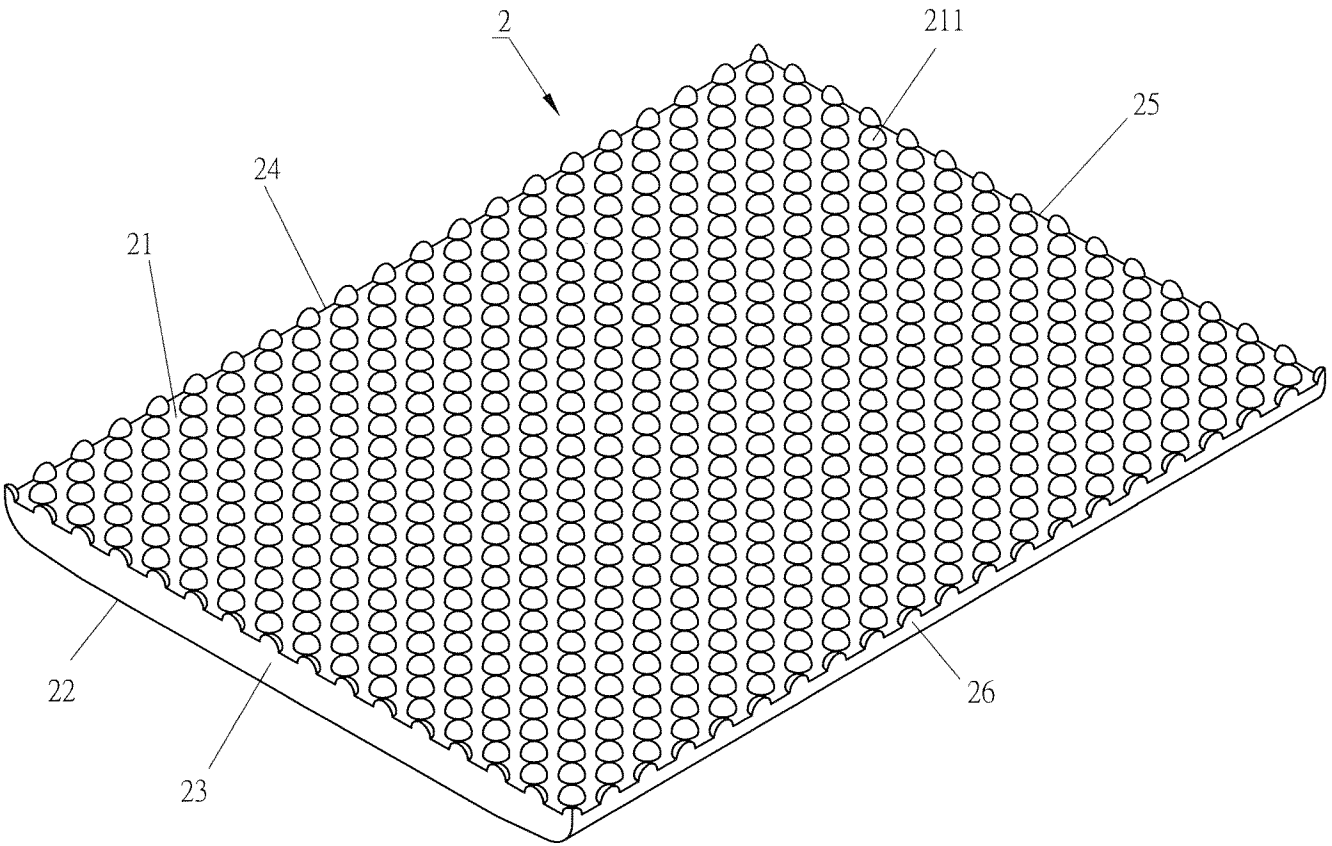
FIG. 2 is a perspective view showing a pad sheet by folding which a pad body of the pad unit is formed according to the first embodiment of the present invention.

Referring to FIG. 2, in the first embodiment, the first and second pad bodies 2 are formed by folding two pad sheets, wherein the two pad sheets are made of any one of sponge, foam, latex, and memory foam. The two pad sheets, which are respectively used to form the first and second pad bodies 2, each have an inner surface 21 and an outer surface 22 opposite to the inner surface 21. In unfolded condition, each of the pad sheets has a first side 23, a second side 24, a third side 25, and a fourth side 26 which are linked together to form a quadrilateral. Moreover, the inner surface 21 of each of the pad sheets has a plurality of granular portions 211 arranged thereon.

Figure 3A:
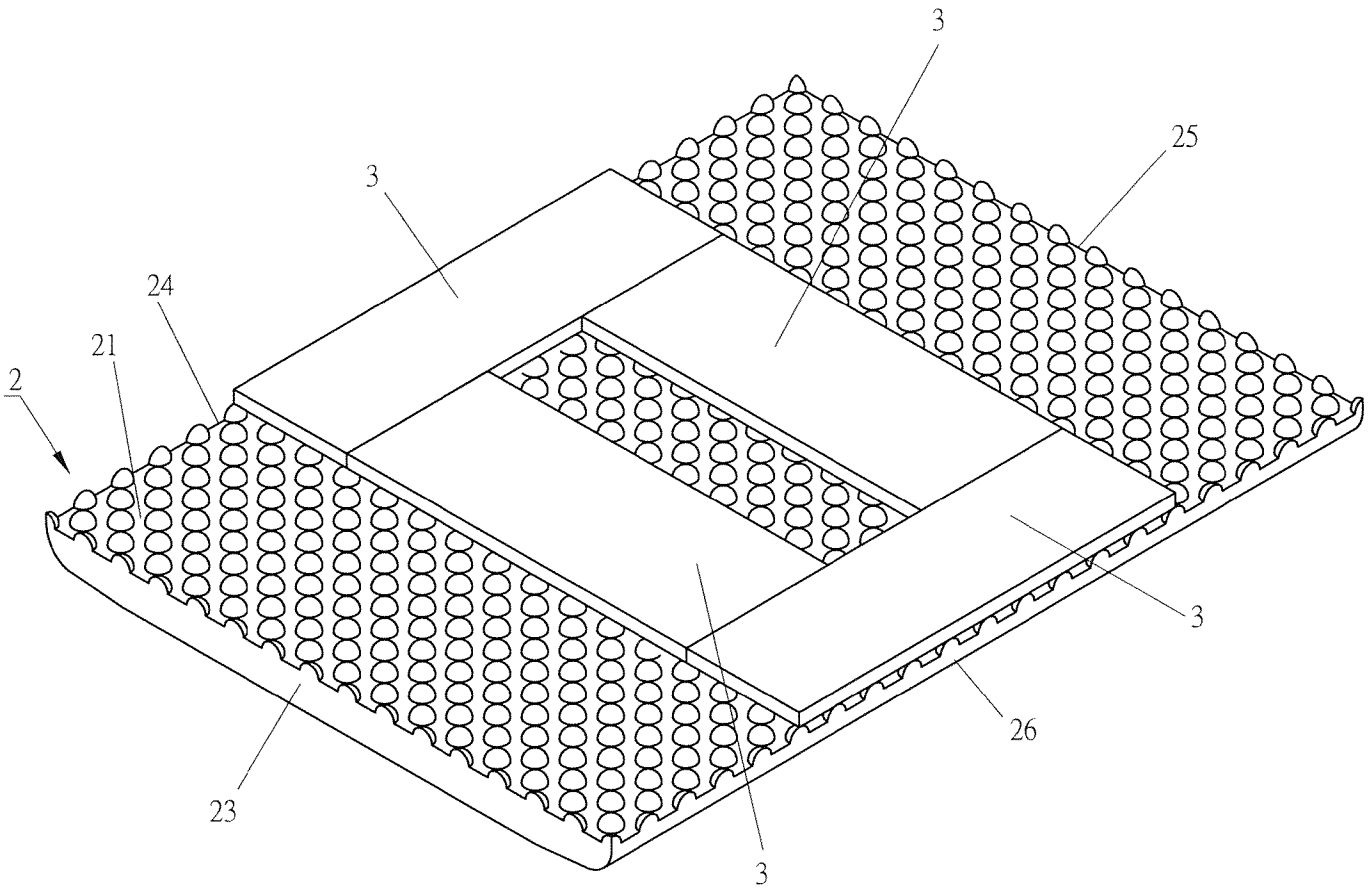
FIG. 3A is a perspective view showing inner pads which are disposed on the inner surface of a respective pad sheet according to the first embodiment of the present invention.
Figure 3B:
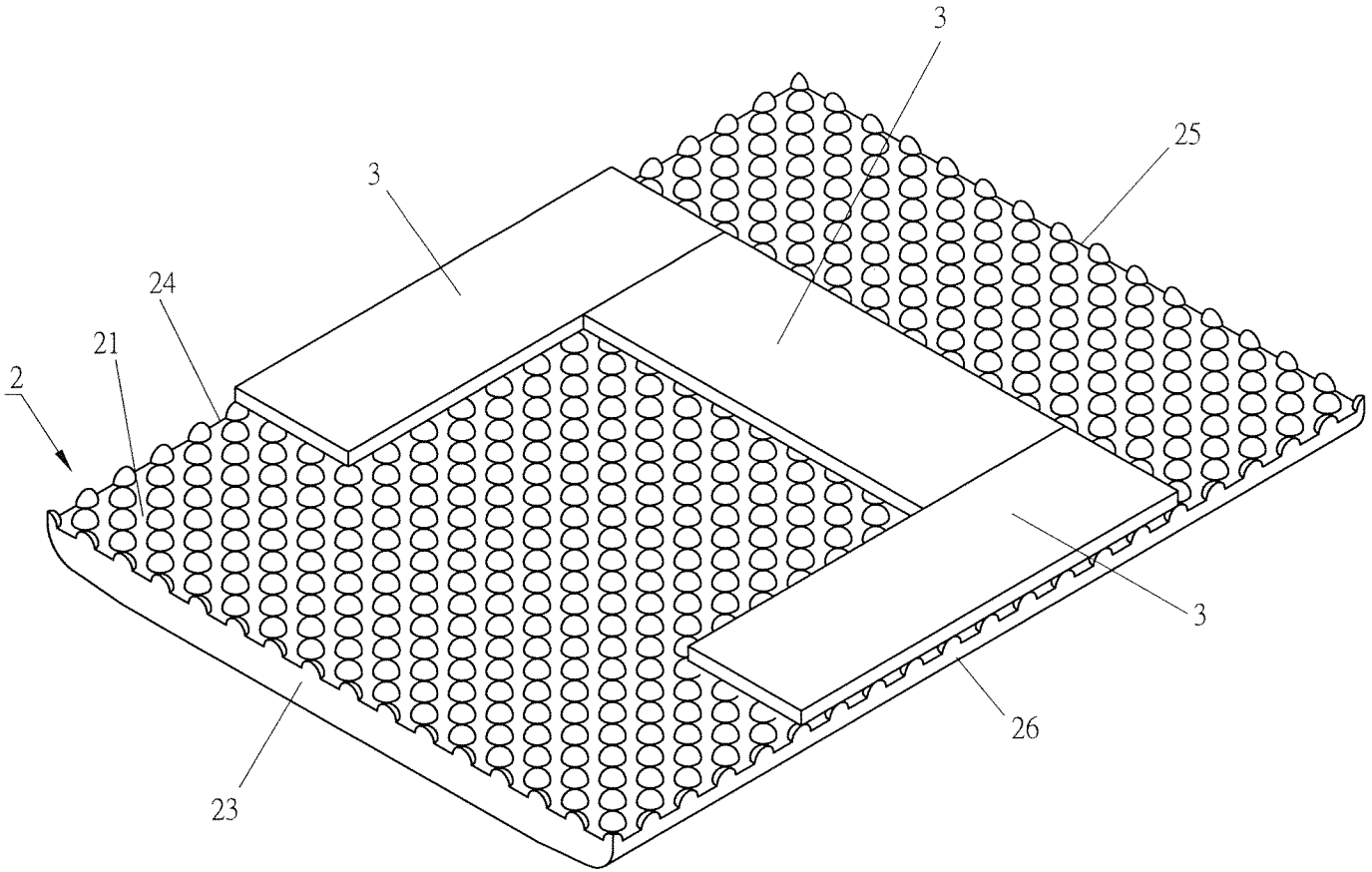
FIG. 3B is another perspective view showing inner pads which are disposed on the inner surface of another respective pad sheet according to the first embodiment of the present invention.

Preferably, as shown in FIGS. 3A and 3B, one of the two pad sheets is provided with four inner pads 3 on the inner surface 21 thereof and the four inner pads 3 are respectively close to the first side 23, the second side 24, the third side 25, and the fourth side 26 thereof; the other one of the two pad sheets is provided with three inner pads 3 disposed on the inner surface 21 thereof and the three inner pads 3 are respectively close to the second side 24, the third side 25, and the fourth side 26 thereof.

Figure 4:
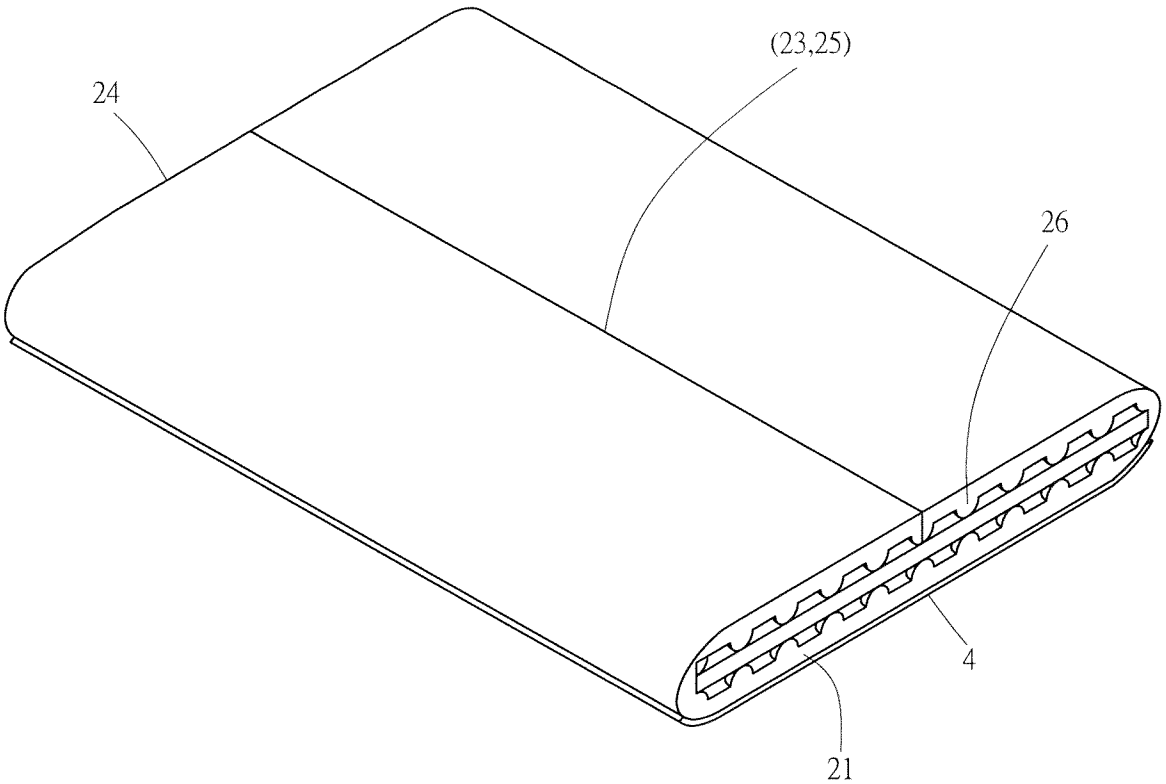
FIG. 4 is a perspective view showing the pad sheet being folded according to the first embodiment of the present invention.
Figure 5:
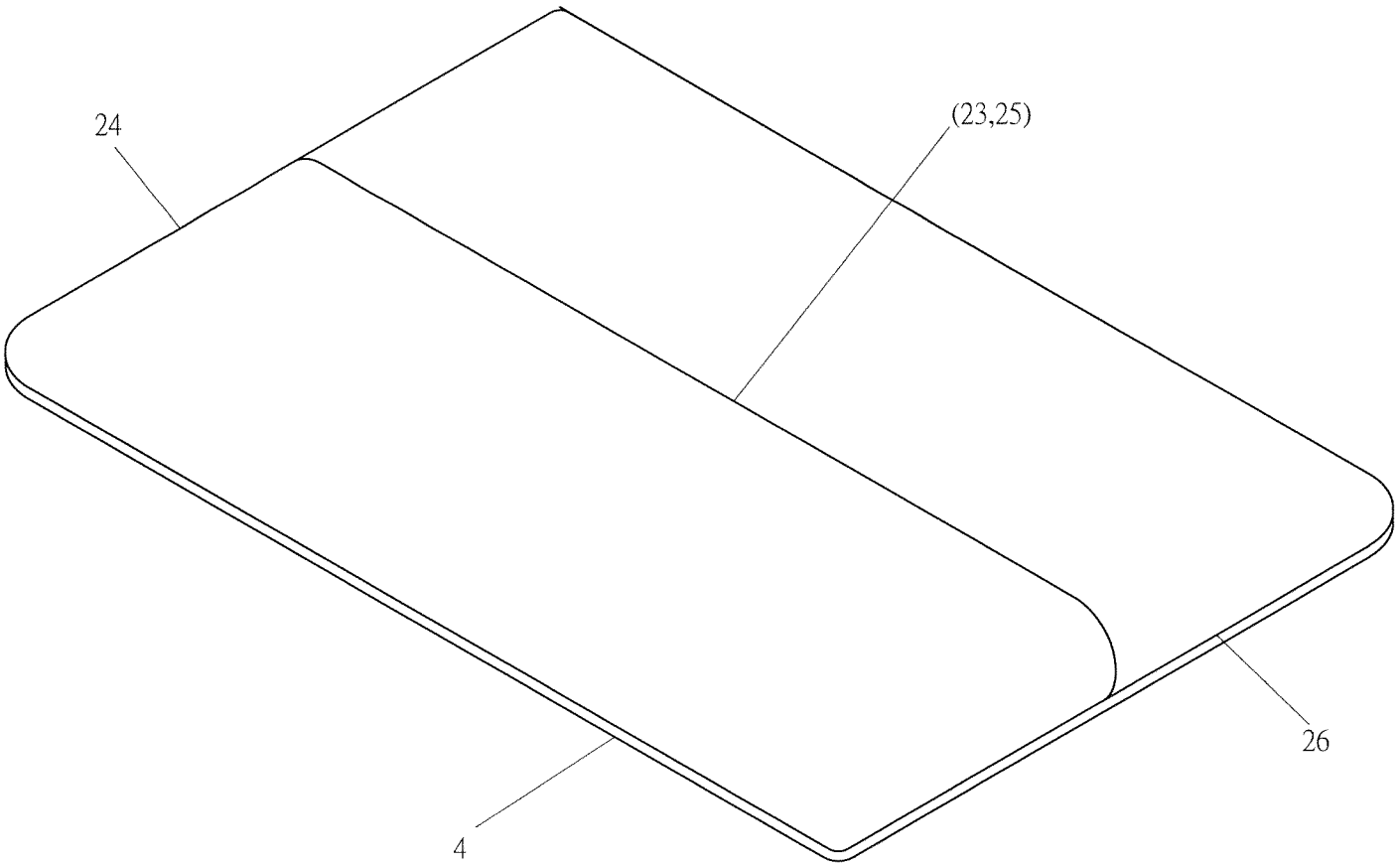
FIG. 5 is a perspective view showing the pad body of the pad structure according to the first embodiment of the present invention.

The first side 23 and the third side 25 of each pad sheet are opposite to each other. In more detail, as shown in FIGS. 4 and 5, the first side 23 and the third side 25 of each respective pad sheet are folded inwardly, i.e., toward the inner surface 21 of each respective pad sheet, to be adhered together, and the second side 24 and the fourth side 26 of each respective pad sheet are then individually adhered in a thickness direction to form a respective one of the first pad body 2 and the second pad body 2. Thereafter, as shown in FIG. 1, the first and second pad bodies 2 are overlapped and at least partially adhered together to form the pad unit 1 with the lateral gap 11. Preferably, one of the first and second pad bodies 2 has a cool gel layer 4 covered on the outer surface 22 thereof.

Figure 6:
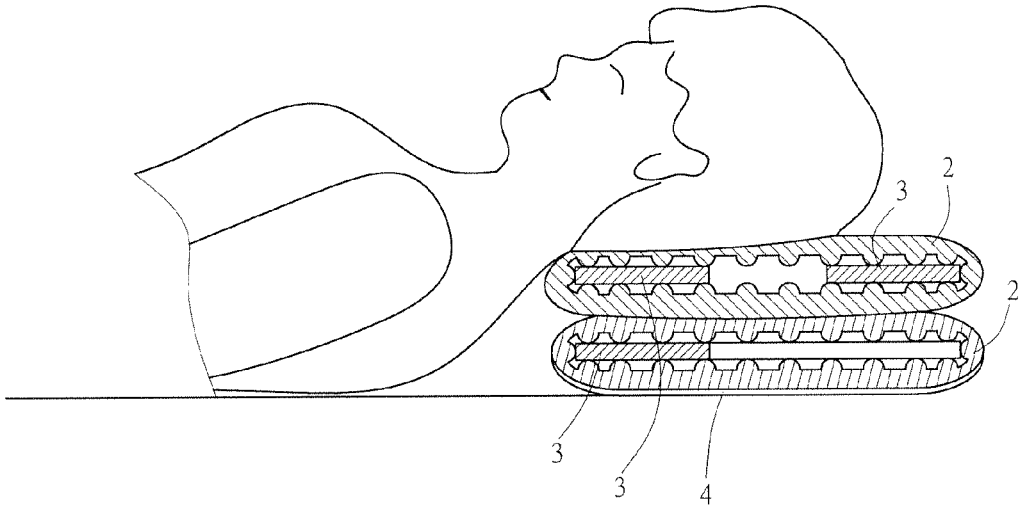
FIG. 6 is a cross sectional view taken along the line A-A of FIG. 1 and showing an application of the pad structure according to the first embodiment of the present invention.
Figure 7:
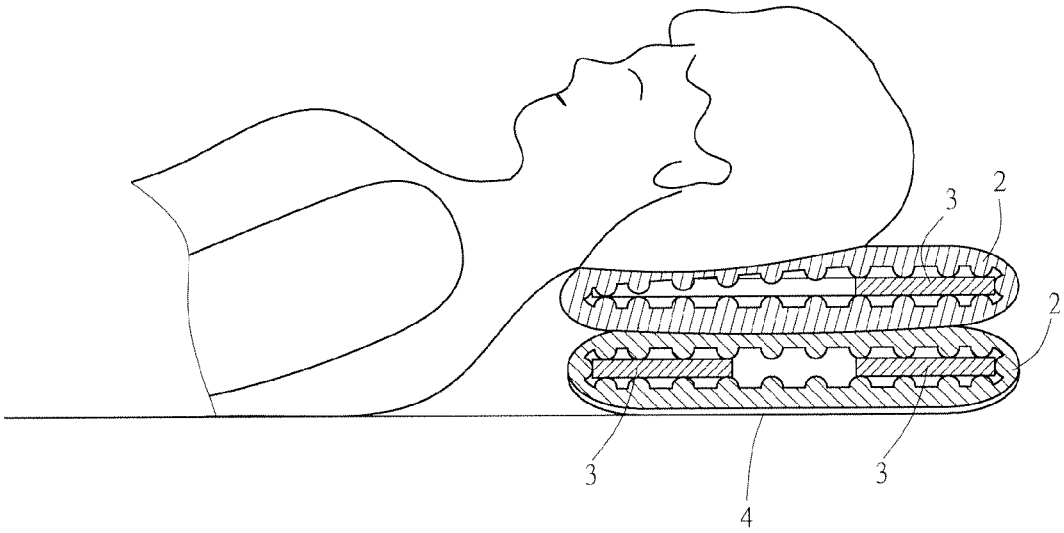
FIG. 7 is another cross sectional view taken along the line A-A of FIG. 1 and showing another application of the pad structure according to the first embodiment of the present invention.

With reference to FIGS. 6 and 7, in this embodiment, the pad unit 1 is used as a pillow. Since one of the two pad sheets only has three inner pads 3 which are respectively disposed close to the second side 24, the third side 25, and the fourth side 26 thereof, the pad unit 1 consisted of the overlapped first and second pad bodies 2 has a first portion being supported by two overlapped inner pads 3 in the thickness direction although a second portion of the pad unit 1 is only supported by a single inner pad 3 in the thickness direction. In use, a user can let his/her head be propped up by the first portion of the pad unit 1 if he/she is used to lying with his/her head at a higher position, so that the pad unit 1 is lightly deformed when it is pressed by the user's head; or the user can let his/her head be propped up by the second portion of the pad unit 1 if he/she is used to lying with his/her head at a lower position so as to cause a larger deformation of the pad unit 1 when the pad unit 1 is pressed by the user's head.

It is to be noted that a central portion of each of the first and second pad bodies 2 are surrounded by the inner pads 3 so that when the first and second pad bodies 2 are overlapped and adhered together to support the user's head, the central portion of each of the first and second pad bodies 2 becomes concaved to match with a profile of the user's head and to avoid forcing user's occipital bone. In addition, because the pad unit 1 has the first and the second pad bodies 2 that are overlapped together, the support capability of the pad unit 1 is enhanced, thus supporting the user's head securely. The lateral gap 11 between the first and second pad bodies 2 can absorb a part of the deformation. In other words, the first and second pad bodies 2 flexibly expend and retract in the lateral gap 11 so as to prevent the two pad bodies 2 from being depressed. Furthermore, the plurality of granular portions 211 on each inner surface 21 are configured to support the user's head, thereby preventing the first and second pad bodies 2 from getting weighed down.

Figure 8:
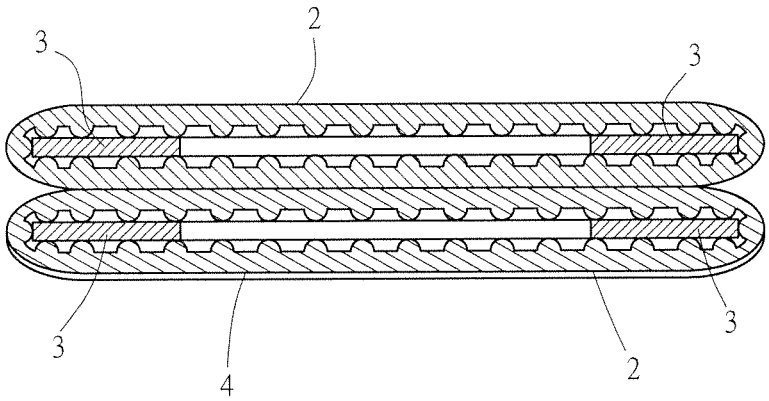
FIG. 8 is a cross sectional view taken along the line B-B of FIG. 1 and showing the application of the pad structure according to the first embodiment of the present invention.
Figure 9:
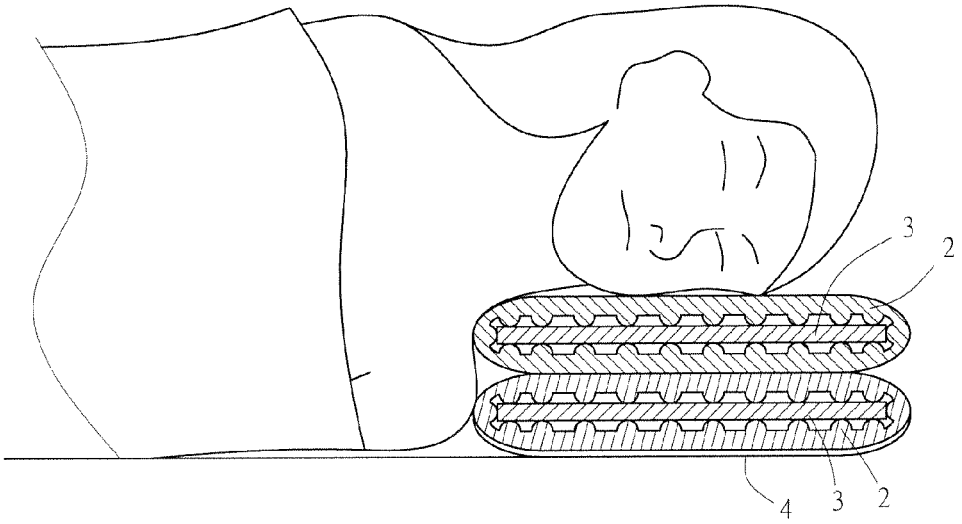
FIG. 9 is a cross sectional view taken along the line C-C of FIG. 1 and showing the application of the pad structure according to the first embodiment of the present invention.

Alternatively, referring to FIGS. 8 and 9, the user's head can be propped up at a height corresponding to a width of the user's shoulder by the inner pads 3. Therefore, the user's neck does not bear additional compressive stress even when the user lies on his/her side, thus avoiding neck's pain and stiff.

Figure 10:
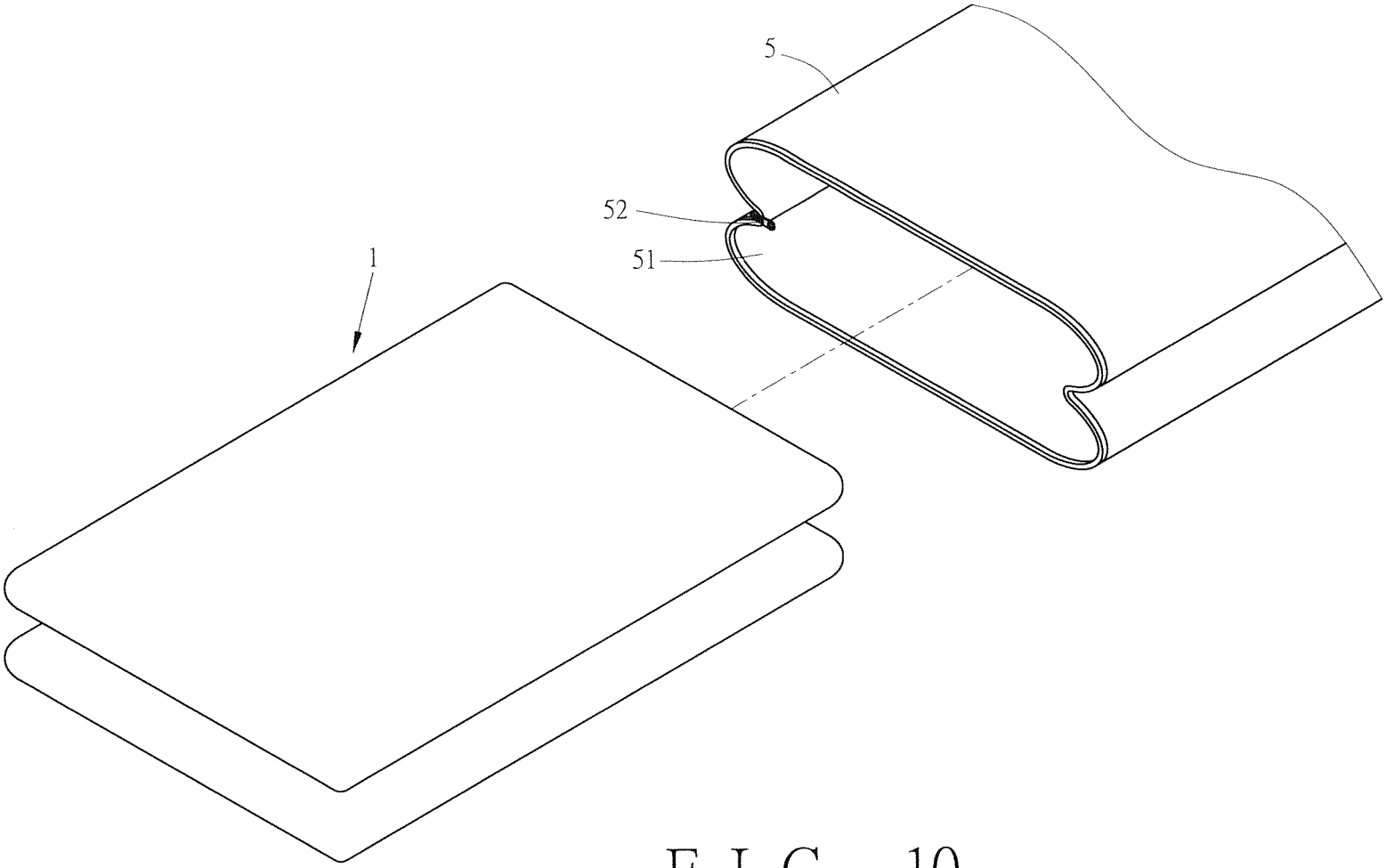
FIG. 10 is a perspective view showing a protective cover being fitted on the pad unit of the pad structure according to the first embodiment of the present invention.

As shown in FIG. 10, a protective cover 5 is provided for preventing the pad unit 1 from dirty. The protective cover 5 includes an accommodating chamber 51 defined therein and a zipper 52 for closing the accommodating chamber 51. The accommodating chamber 51 fits with the pad unit 1 so that the pad unit 1 can be received by the accommodating chamber 51.

Figure 11:
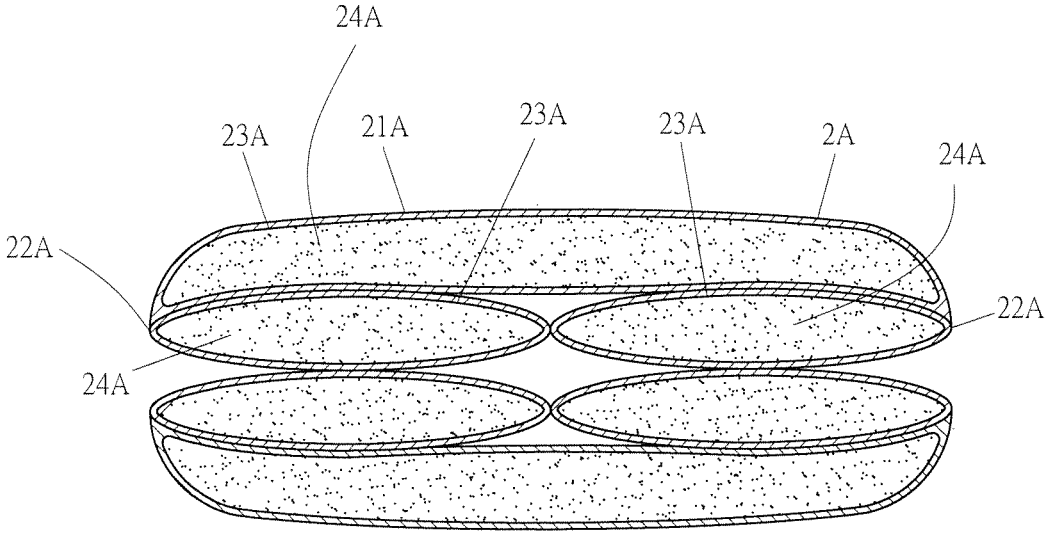
FIG. 11 is a cross sectional view showing the assembly of a pad structure according to a second embodiment of the present invention.

FIG. 11 shows a pad structure according to a second embodiment of the present invention. The two pad sheets used to form the first and second pad bodies 2A further comprises two case members 21A. Each of the two case members 21A has two sewing threads 22A disposed thereon, and an inner space of each of the two case members 21A is divided into three filling spaces 23A by the two sewing threads 22A of each of the two case members 21A. Moreover, three fillers 24A are respectively filled in the three filling spaces 23A of each of the two case members 21A, wherein each filler 24A is any one of cotton, silk and feathers. Two opposite sides of each of the two case members 21A are bent inwardly along the two sewing threads 22A and adhered to each other, thus forming a respective one of the first and second pad bodies 2A.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A pad structure comprising:

a pad unit including a first pad body and a second pad body disposed in an overlaying relationship, each pad body having a pad sheet with opposing inner and outer surfaces;

each pad sheet having four sides, and including:

a plurality of granular protrusions protruding from the inner surface of the pad sheet, the granular protrusions being disposed in a spaced longitudinal and lateral relationship one from another to define cavities therebetween; and at least three inner pads disposed atop a portion of the plurality of granular portions, each inner pad corresponds to and extends longitudinally relative to a different side of the pad sheet;

wherein each pad sheet is disposed in a folded contour about its respective inner pads with the respective plurality of granular protrusions and cavities of overlaying portions of the pad sheet being in an opposed facing spaced relationship; and wherein the at least three inner pads of the first pad body together have a first configuration and the at least three inner pads of the second pad body together have a second configuration, wherein the second configuration is different from the first configuration.

2. The pad structure as claimed in claim 1, wherein a first side is opposite to a third side; each pad sheet being folded from the first and third sides toward the inner surface, wherein the first and third sides are adhered to each other to form a respective one of the first and second pad bodies.

3. The pad structure as claimed in claim 2, wherein a second side and a fourth side are respectively adhered in a thickness direction.

4. The pad structure as claimed in claim 2, wherein each pad sheet is made of a material selected from the group consisting of sponge, foam, latex and memory foam.

5. The pad structure as claimed in claim 3, wherein the pad sheet of the first pad body has four inner pads being respectively disposed on the first side, the second side, the third side, and the fourth side thereof, and the pad sheet of the second pad body has three inner pads being respectively disposed on the second side, the third side, and the fourth side thereof.

6. The pad structure as claimed in claim 2, wherein each pad sheet comprises a case member, each case member having: two sewing threads disposed thereon; an inner space divided into three filling spaces by the two sewing threads; and three fillers respectively filled in the three filling spaces; and wherein each case member has two opposite sides being bent inwardly along the two sewing threads dispose thereon and being adhered to each other.

7. The pad structure as claimed in claim 6, wherein the fillers are any one of cotton, silk and feathers.

8. The pad structure as claimed in claim 1, wherein at least one of the pad sheets has a cool gel layer covered on the outer surface thereof.

9. The pad structure as claimed in claim 1 further comprising a protective cover, wherein the protective cover has an accommodating space defined therein and has a zipper for closing the accommodating space, and the accommodating space fits with the pad unit so as to receive the pad unit therein.

* * * * *